United States Patent [19]

Asano et al.

[11] 4,153,022

[45] May 8, 1979

[54] ELECTRONIC CLOSED LOOP AIR-FUEL RATIO CONTROL SYSTEM

[75] Inventors: Masaharu Asano; Mitsuhiko Ezoe, both of Yokosuka, Japan

[73] Assignee: Nissan Motor Company, Limited, Yokohama, Japan

[21] Appl. No.: 794,138

[22] Filed: May 5, 1977

[30] Foreign Application Priority Data

May 8, 1976 [JP] Japan ..... 51-51695

[51] Int. Cl.[2] ..... F02B 3/00

[52] U.S. Cl. ..... 123/119 EC; 123/32 EE

[58] Field of Search ..... 123/32 EE, 32 EJ, 119 EC; 60/276, 285

[56] References Cited

U.S. PATENT DOCUMENTS

| | | | |
|---|---|---|---|
| 3,855,974 | 12/1974 | Mayer | 123/119 EC X |
| 3,998,189 | 12/1976 | Aoki | 123/32 EE |
| 4,029,061 | 6/1977 | Asano | 123/32 EE |
| 4,031,866 | 6/1977 | Asano | 123/32 EE X |

*Primary Examiner*—Charles J. Myhre
*Assistant Examiner*—Tony M. Argenbright
*Attorney, Agent, or Firm*—Schwartz, Jeffery, Schwaab, Mack, Blumenthal & Koch

[57] ABSTRACT

A control means is provided in an electronic closed loop air-fuel ratio control system for use with an internal combustion engine, which means controls a time constant of an integrator or a proportional constant of a proportional element of the system so as to optimally control the air-fuel ratio.

10 Claims, 23 Drawing Figures

Fig. 3a
Fig. 3b
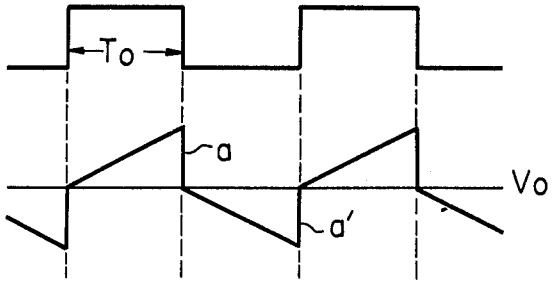
Fig. 4a
Fig. 4b
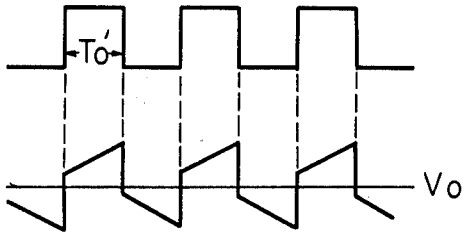
Fig. 4c
Fig. 4d
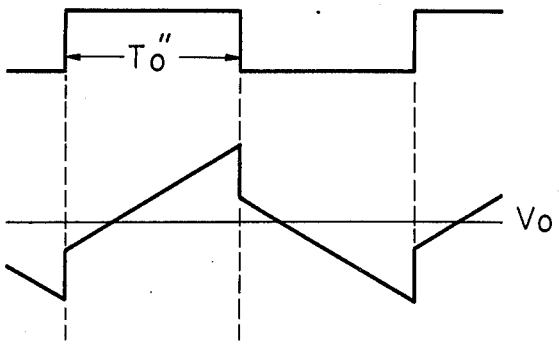

Fig. 5
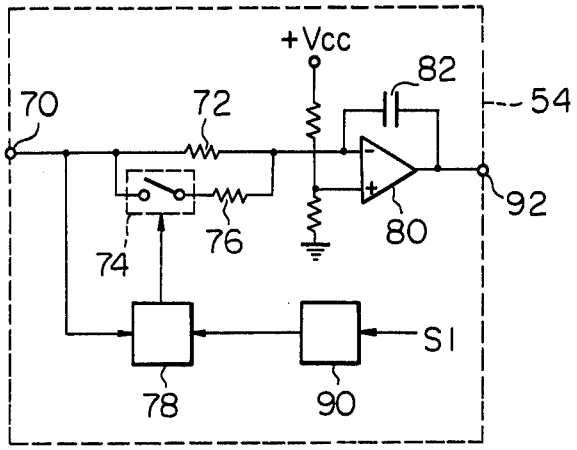
Fig. 6a
Fig. 6b
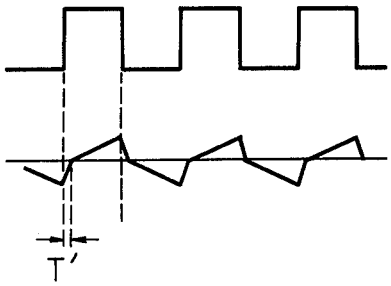
Fig. 7a
Fig. 7b
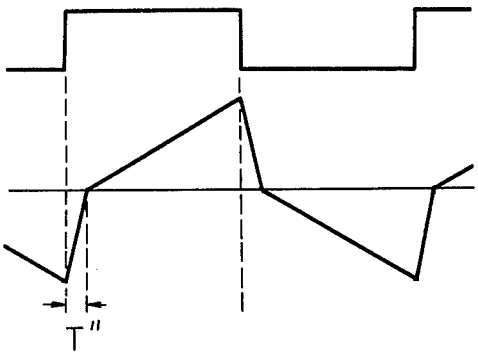

Fig. 8
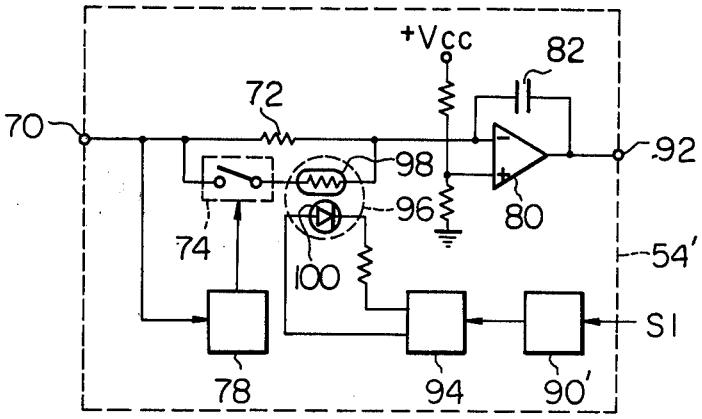
Fig. 9a
Fig. 9b
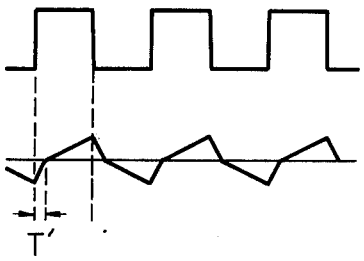
Fig. 10a
Fig. 10b
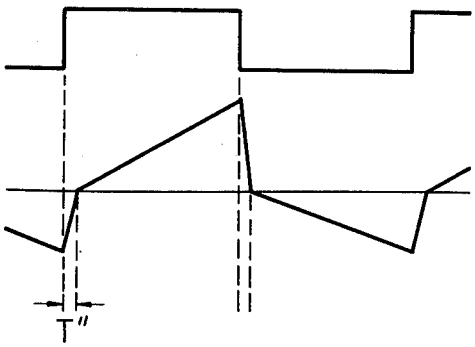

Fig. 11
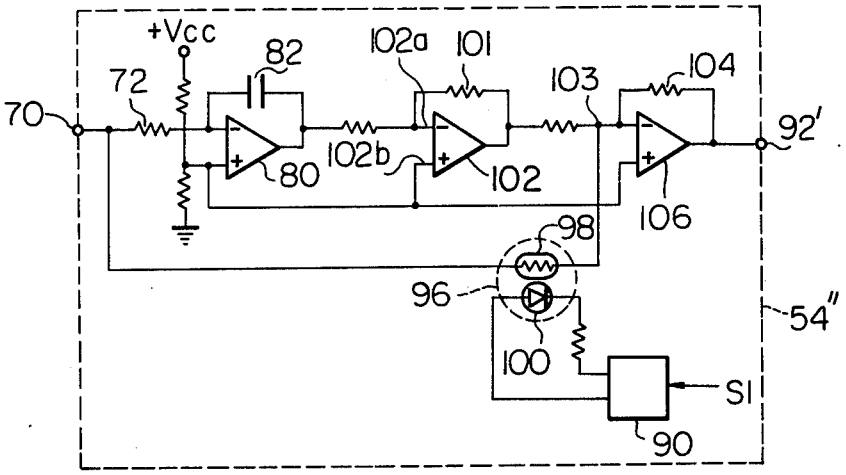
Fig. 12a
Fig. 12b
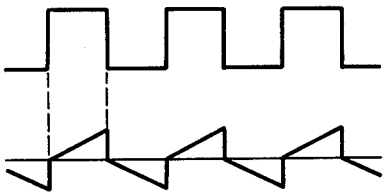
Fig. 13a
Fig. 13b
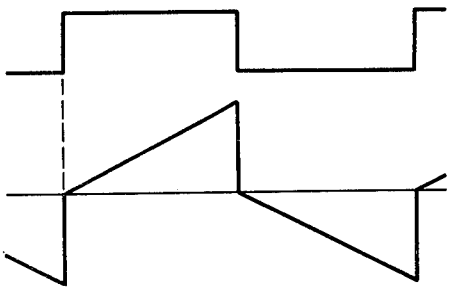

ELECTRONIC CLOSED LOOP AIR-FUEL RATIO CONTROL SYSTEM

BACKGROUND OF THE INVENTION

The present invention relates generally to an electronic closed loop air-fuel ratio control system for use with an internal combustion engine, and particularly to an improvement in such a system for optimally controlling the air-fuel mixture fed to the engine by controlling a time constant of an integrator or a proportional constant of a proportional circuit of the system.

Various systems have been proposed to supply an optimal air-fuel mixture to an internal combustion engine to reduce noxious components of the emissions, one of which utilizes the concept of an electronic closed loop control system based on a sensed concentration of a component in exhaust gases of the engine.

According to the conventional system, an exhaust gas sensor, such as an oxygen analyzer, is deposited in an exhaust pipe for sensing the concentration of a component of exhaust gases from an internal combustion engine, generating an electrical signal representative of the sensed concentration of the component. A differential signal generator is connected to the sensor for generating an electrical signal representaive of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom, and generating a signal. A pulse generator is connected to the p-i controller receiving the signal therefrom, generating a train of pulses based on the signal received, which pulses are fed to an air-fuel ratio regulating means, such as electromagnetic valves, for supplying an air-fuel mixture with an optimum air-fuel ratio to the engine.

In the previously described conventional control system, however, a problem is encountered as follows. That is, the output of the proportional controller is undesirably changed depending upon engine speed change, with the result of the fact that the air-fuel ratio control can not be properly carried out. The reason why the engine speed change affects the output of the p-i controller is that the response transient of the system is not negligible. The above described defect of the prior art will be discussed in detail in connection with FIGS. 4a-4d of the accompanying drawings.

SUMMARY OF THE INVENTION

It is therefore an object of the present invention to improve the transient response characteristic of a closed loop air-fuel ratio control system for internal combustion engines.

Another object of the present invention is to provide an improved electronic closed loop air-fuel ratio control system wherein the time constant of an integrator of the system is controlled so as to optimally control the air-fuel ratio.

Still another object of the present invention is to provide an improved electronic closed loop air-fuel ratio control system wherein a proportional constant of a proportional circuit is controlled so as to optimally control the air-fuel ratio.

BRIEF DESCRIPTION OF THE DRAWINGS

These and other objects, features and many of the attendant advantages of this invention will be appreciated more readily as the invention becomes better understood by the following detailed description, taken with the accompanying drawings wherein like parts in each of the several figures are identified by the same reference characters, and wherein:

FIGS. 3a and 3b show waveforms of signals appearing at two points of the system of FIG. 1;

FIGS. 4a–4d show waveforms of signals appearing at specified points of the system of FIG. 1 for illustrating defects inherent in the conventional system;

FIG. 5 illustrates a first preferred embodiment of the present invention;

FIGS. 6a–7b show waveforms of input and output signals of the first preferred embodiment;

FIG. 8 illustrates a second preferred embodiment of the present invention;

FIGS. 9a–10b show waveforms of input and output signals of the second preferred embodiment;

FIGS. 11 illustrates a third preferred embodiment of the present invention; and FIGS. 12a–13b show waveforms of input and output signals of the third preferred embodiment.

DETAILED DESCRIPTION

Figure 1:
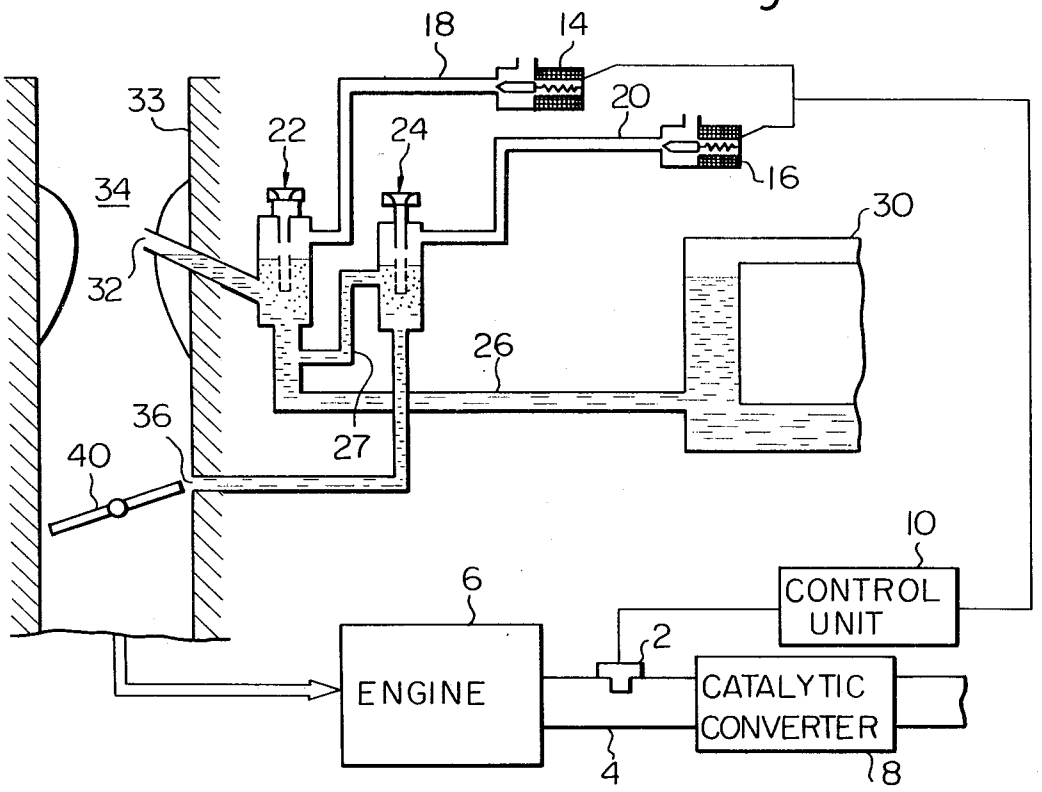
FIG. 1 schematically illustrates a conventional electronic closed loop air-fuel ratio control system for regulating the air-fuel ratio of the air-fuel mixture fed to an internal combustion engine.

Before going into the details of the present invention, reference is first made to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. In response to the command signal two electromagnetic values 14 and 16 are energized. The control unit 10 will be described in more detail in conjunction with FIG. 2.

Figure 2:
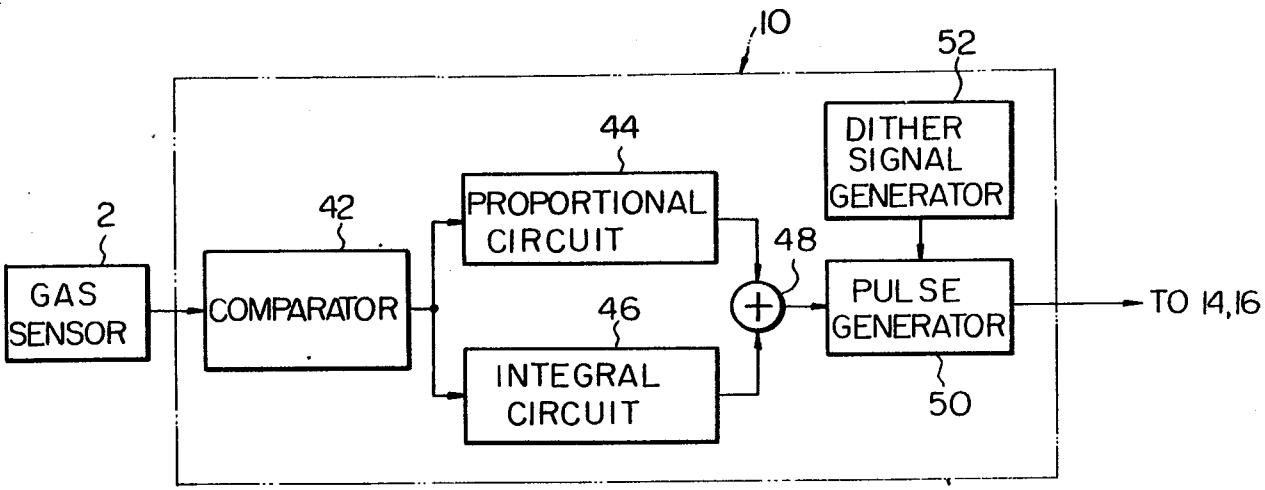
FIG. 2 is a detailed block diagram of an element of the system of FIG. 1.

The electromagnetic valve 14 is provided in an air passage 18, which terminates at one end thereof at an air bleed chamber 22, to control a rate of air flowing into the air bleed chamber 22 in response to the command pulses from the control unit 10. The air bleed chamber 22 is connected to a fuel passage 26 for mixing air with fuel delivered from a float bowl 30, supplying the air-fuel mixture to a venturi 34 through a discharging (or main) nozzle 32. Whilst, the other electromagnetic valve 16 is provided in another air passage 20, which terminates at one end thereof at another air bleed chamber 24, to control the rate of air flowing into the air bleed chamber 24 in response to the command pulses from the control unit 10. The air bleed chamber 24 is connected to the fuel passage 26 through a fuel branch passage 27 for mixing air with fuel from the float bowl 30, supplying the air-fuel mixture to an intake passage 33 through a slow nozzle 36 adjacent to a throttle 40. As shown, the catalytic converter 8 is provided in the exhaust pipe 4 downstream of the exhaust gas sensor 2. In the case where, for example, a three-way catalytic converter is employed, the electronic closed loop control system is designed to set the air-fuel ratio of the air-fuel mixture to about stoichiometric. This is because the three-way catalytic converter is able to simultaneously and most effectively reduce nitrogen oxides ($NO_x$), carbon monoxide (CO), and hydrocarbons (HC), only when the air-fuel mixture ratio is set at about stoichiometric. It is apparent, on the other hand, that, when other catalytic converter such as an oxidizing or deoxidizing type is employed, the setting value may be different from the stoichiometric value. FIG. 2 illustrates the details of the control unit 10. The signal from the exhaust gas sensor 2 is fed to a comparator 42 of the control unit 10, which circuit compares the incoming signal with a reference value to generate a signal representing the difference therebetween. The signal from the comparator 42 is then fed to two circuits, viz., a proportional circuit 44 and an integration circuit 46. The purpose of the provision of the proportional circuit 44 is, as is well known to those skilled in the art, to increase the response characteristics of the system, and whilst the purpose of the integration circuit 46 is to stabilize the operation of the system and to generate an integrated signal which is used in generating the command pulses in a pulse generator 50. The signals from the circuit 44 and 46 are then fed to an adder 48 in which the two signals are summed. The signal from the adder 48 is then applied to the pulse generator 50 to which a dither signal is also fed from a dither signal generator 52. The command signal, which is in the form of pulses, is fed to the valves 14 and 16, thereby to control the "on" and "off" operation thereof.

Although the electronic closed loop air-fuel ratio control system is shown as composing a carburetor in FIG. 1, the system is also applicable to a fuel injection device.

Reference is now made to FIGS. 3*a* and 3*b*, which respectively show waveforms of the signals from the comparator 42 and the adder 48. The signal from the comparator 42 has a pulse width $T_o$ in the case of which it is assumed in this specification that the signal from the adder 48 has a waveform as shown in FIG. 3*b*. From the standpoint of the system response characteristic, the controller's output should preferably vary symmetrically with respect to a reference value $V_o$ as indicated by amplitude a and a' in FIG. 3*b*.

However, since the pulse width of the signal from the comparator 42 changes as a function of engine speed, the waveform such as shown in FIG. 3*b* is no longer obtained. More specifically, FIGS. 4*a* and 4*c* designate waveforms of the signal from the comparator 42 when the engine speed is high and low (pulse widths $T_o'$ and $T_o''$), respectively. In these cases, each of the proportional components (no numerals) corresponding to "a" and "a'" in FIG. 3*b*, is not equal to the difference between the peak level and the reference value $V_o$, resulting in the worse response time of the system.

Reference is now made to FIG. 5, which illustrates a first preferred embodiment of the present invention. The signal from the comparator 42 is fed to a circuit 54, which corresponds to the integral circuit 46 of FIG. 2, through an input terminal 70 to an operational amplifier 80 via a resistor 72 and also to a variable delay monostable miltivibrator 78. The monostable multivibrator 78 is triggered by each of the leading and the trailing edges of the signal fed thereto through the terminal 70, generating a switch activating pulse to close a switch 74. When the switch 74 closes, the time constant of the resistor 72 and a capacitor 82 is reduced. On the contrary, the pulse duration of the monostable 78 is controlled by a signal from a frequency-voltage converter 90 in such a manner as to be inversely proportional to the magnitude of a signal S1, which is fed to the converter 90 and indicates an engine operation parameter such as engine speed or the amount of air inducted, that the switch 74 is closed for a period inversely proportional to the engine speed. The output of the amplifier 80 is fed to the pulse generator 50 (FIG. 2) through a terminal 92.

The operation of the circuit of FIG. 5 will be best understood with reference to FIGS. 6*a*, 6*b*, 7*a* and 7*b*. Assuming that the engine speed is high so that the signal from the comparator 42 has a high repetition rate (FIG. 6*a*), then, the monostable multivibrator 78 has a pulse duration T' as shown in FIG. 6*b*. On the contrary, in the case where the engine speed is low so that the signal from the comparator 42 has a low repetition rate (FIG. 7*a*), the pulse duration of the monostable multivibrator 78 increases to T'' as shown in FIG. 7*b*.

Reference is now made to FIG. 8, which illustrates a second preferred embodiment of the present invention. In brief, the difference between the first and the second preferred embodiments is that in the latter, the output of the frequency-voltage converter 90' is connected to an inverter 94 and that the converter 90' generates a signal proportional to the frequency of the signal S1. A transducer unit 96 is provided which includes a photo-sensitive resistance element 98 interposed between switch 74 and the inverting input of amplifier 80 and a light emitting diode (LED) 100 connected to the output of the inverter 94. The resistance of the element 98 decreases as the light emitted from the LED 100 increases with increase of the voltage from the inverter 94. The inverter 94 generates a signal the magnitude of which is inversely proportional to the magnitude of the signal from the converter 90'. Therefore, the voltage applied to the unit 96 is proportional to the frequency of the signal applied to the converter 90'. In this embodiment the monostable multivibrator 78 is of a conventional constant duration time, since the resistance of the element 98 decreases in proportion to the frequency of the signal S1 applied to the converter 90'. Since the frequency of the signal S1 is proportional to the engine speed, the time constant of the integrator 80 increases as a function of the frequency of the signal $S_1$.

The operation of the circuit of FIG. 8 will best be understood with reference to FIGS. 9*a*, 9*b*, 10*a* and 10*b*. Assuming that the engine speed is so high that the signal from the comparator 42 has a high repetition rate (FIG. 9*a*), then, the time constant of the integrator 80 becomes large. On the other hand, in cases where the engine speed is low so that the signal from the comparator 42 has a low repetition rate (FIG. 10*a*), the time constant of the integrator 80 becomes small as shown in FIG. 10*b*. Therefore, the defect as previously referred to in connection with FIGS. 4*a*–4*d* can be removed.

Reference is now made to FIG. 11, which illustrates a third preferred embodiment of the present invention. The difference between the third preferred embodiment and the preceding ones is that the former includes a proportional controller which is in this embodiment the photo-sensitive element 98. The output terminal (no numeral) of the integrator operational amplifier 80 is connected to the inverting input terminal 102*a* of an operational amplifier 102 whose output is coupled by a feedback resistor 101 to the inverting input. On the other hand, a non-inverting input terminal 102*b* is directly connected to the non-inverting input terminal (no numeral) of the amplifier 80. The amplifier 102 provides phase inversion of signals from the integrator so that the signals modified by integrator 80 and the proportional controller 98 are brought into phase with each other at the inverting input of a summation amplifier 106. The resistance of the photo-sensitive element 98 is controlled by the light emitted from the LED 100 as previously referred to in connection with the second preferred embodiment. Since the intensity of the light from the LED 100 is proportional to the magnitude of the signal from the frequency-voltage converter 90, which magnitude is in turn inversely proportional to the frequency of the signal S1, the resistance of the element 98 increases with the frequency of signal $S_1$ so that the proportionality factor decreases therewith. Conversely, as the frequency of the signal S1 decreases (that is, the pulse width of the signal from the comparator 42 becomes wider), the resistance of the element 98 decreases so that the portionality factor increases as seen from FIGS. 12*a*, 12*b*, 13*a* and 13*b*.

In the above, the switch 74 is usually a suitable semiconductor switching means.

It is understood from the foregoing that, according to the present invention, the air-fuel mixture ratio can be optimally controlled by controlling the time constant of the integrator or the proportional constant of the proportional element of the system.

What is claimed is:

1. An electronic closed loop air-fuel ratio control system for supplying an optimum air-fuel mixture to an internal combustion engine, which system comprises in combination:

an air-fuel mixture supply assembly connected to the engine;

an exhaust gas pipe connected to the engine;

an exhaust gas sensor provided in the exhaust pipe for sensing the concentration of an exhaust component in the exhaust gases for generating a concentration representative signal;

a comparator responsive to said concentration representative signal for generating a comparator signal at one of high and low values depending upon whether said concentration representative signal is above or below a reference value;

an integral controller connected to the comparator including a first resistor and a capacitor connected in series thereto, a second resistor and switching means which, when energized, connects said first and second resistors in parallel circuit relation;

a monostable multivibrator responsive to said comparator signal to generate an electrical pulse for energizing said switching means;

means for generating a signal of which the magnitude is an inverse function of the speed of said engine, said signal being applied to said monostable multivibrator for the varying duration of said electrical pulse; and an actuator provided in the air-fuel mixture supply assembly responsive to the output of said integral controller to control the air-fuel ratio of the mixture fed to the engine.

2. An electronic closed loop air-fuel mixture control system for an internal combustion engine including means for supplying air and fuel in a variable ratio in response to a control signal applied thereto, which system comprises in combination:

an exhaust gas sensor for sensing the concentration of an exhaust composition in the emissions from the engine for generating a concentration representative signal;

a comparator connected to be responsive to said concentration representative signal for generating a comparator signal at one of high and low values depending on whether the concentration representative signal is above or below a reference value;

an integrator connected to the comparator for modifying the waveform of said comparator signal;

a photosensitive resistor connected to the output of said comparator;

means for detecting an engine operating parameter;

means for emitting light in response to the detected engine operating parameter toward said photosensitive resistor to modify its resistance; and an adder connected to both the integrator and the photosensitive resistor for providing summation of the signals passing therethrough to generate a control signal;

3. An electronic closed loop air-fuel ratio control system as claimed in claim 2, further comprising:

a frequency-voltage converter receiving a signal the frequency of which represents engine speed, generating a voltage which is proportional to the frequency; and a light emitting diode connected to the converter, receiving the signal therefrom, and being controlled such that the light emitted increases and decreases as the magnitude of the signal received increases and decreases, respectively, whereby the resistance of the proportional element changes in such a manner as to be proportional to the engine speed.

4. An electronic closed loop air-fuel ratio control system for internal combustion engines having means for supplying air and fuel in a variable ratio in accordance with a feedback control signal, comprising:

an exhaust gas sensor for generating a signal representative of the concentration of a predetermined constituent gas in the emissions from the engine;

a comparator responsive to said concentration repesentative signal to generate a comparator signal at one of high and low discrete values depending upon whether said concentration representative signal is above or below a reference value;

an integral controller connected to said comparator and including a first resistor, a capacitor connected in series thereto, a second resistor and switching means which, when energized, connects said second resistor in parallel with said first resistor for generating an integral controller signal which is said feedback control signal;

a monostable multivibrator for generating an electrical pulse in response to said comparator signal for energizing said switching means; and means for controlling the resistance value of said second resistor in proportion to the speed of said engine.

5. An electronic closed loop air-fuel ratio control system as claimed in claim 4, wherein the second resistor is a photo-sensitive resistor, and wherein the controlling means comprises:

a frequency-converter receiving a signal the frequency of which represents engine speed, generating a voltage which is proportional to the frequency;

an inversely proportional circuit receiving the signal from the converter, generating a signal the magnitude of which is inversely proportional to that of the signal received; and a light emitting diode connected to the inversely proportional circuit, receiving the signal therefrom, and being controlled such that the light emitted increases and decreases as the magnitude of the signal received increases and decreases respectively, whereby the resistance of the second resistor changes in such a manner as to be proportional to the engine speed.

6. A method of operating a closed loop mixture control system for internal combustion engines including an exhaust gas sensor for generating an exhaust gas sensor signal representative of the concentration of a predetermined constituent gas of the emissions, means for generating a signal representative of the deviation of said exhaust gas sensor signal from a reference value, an integral controller for modifying the magnitude of said deviation representative signal with variable integration rates, and means for supplying air and fuel to said engine in a variable ratio in accordance with said integral controller signal, the method comprising the steps of increasing the integration rate for an interval of time in response to said deviation-representative signal crossing said reference value, detecting an engine operating parameter, and varying said interval of time in accordance with the detected engine operating parameter.

7. A method as claimed in claim 6, wherein said engine operating parameter is representative of the speed of said engine.

8. A closed loop mixture control system for internal combustion engines including an exhaust gas sensor for generating an exhaust gas sensor signal representative of the concentration of a predetermined constituent gas of the exhaust emissions, a comparator for generating a comparator signal at a first or a second voltage level depending on whether said exhaust gas sensor signal is above or below a reference point representing a desired air-fuel ratio of the mixture, an integral controller for modifying the magnitude of said comparator signal to generate an integral controller signal representative of the time integral of said comparator signal, and means for supplying air and fuel to said engine in a variable ratio in accordance with said integral controller signal, said system comprising:

variable-time monostable means responsive to said comparator signal for generating a first switching control pulse in response to the first voltage level of said comparator signal and a second switching control pulse in response to the second voltage level of said comparator signal;

means for switching the integration rate of said integral controller from a high to a low value in the presence of said first or second switching control pulse; and means for deriving an engine speed signal representative of the speed of said engine, said engine speed signal being applied to said variable monostable means for controlling the duration of said first and second switching control pulses as a function of the engine speed.

9. A closed loop mixture control system for internal combustion engines including an exhaust gas sensor for generating an exhaust gas sensor signal representative of the concentration of a predetermined constituent gas of the exhaust emissions, a comparator for generating a comparator signal at a first or a second voltage level depending on whether said exhaust gas sensor signal is above or below a reference point representing a desired air-fuel ratio of the mixture, an integral controller for modifying the magnitude of said comparator signal to generate an integral controller signal representative of the time integral of said comparator signal, and means for supplying air and fuel to said engine in a variable ratio in accordance with said integral controller signal, said system comprising:

a monostable multivibrator connected to be responsive to said comparator signal to generate a first switching control pulse in response to the first voltage level of said comparator signal and a second switching control pulse in response to the second voltage level of said comparator signal;

means for switching the integration rate of said integral controller from a high to a low value in the presence of said first or second switching control pulse; and means for deriving an engine speed signal representative of the speed of said engine and varying said low value of integration rate in accordance with said engine speed signal.

10. A closed loop mixture control system for internal combustion engines including an exhaust gas sensor for generating an exhaust gas sensor signal representative of the concentration of a predetermined constituent gas of the exhaust emissions, a comparator for generating a comparator signal at a first or a second voltage level depending on whether said exhaust gas sensor signal is above or below a reference point representing a desired air-fuel ratio of the mixture, an integral controller for modifying the magnitude of said comparator signal to generate an integrator signal representative of the time integral of said comparator signal, a proportional controller for modifying the magnitude of said comparator signal by a proportionality factor to generate a proportional controller signal, means for summing up said integrator and proportional controller signals to provide an additive output signal, and means for supplying air and fuel to said engine in a variable ratio in accordance with said additive output signal, said system comprising:

means for deriving an engine speed signal representative of the speed of said engine; and means for translating said engine speed signal into light energy;

said proportional controller comprising a photosensitive resistance element exposed to said light energy to vary said proportionality factor in accordance with said engine speed.

* * * * *